US010329674B2

(12) United States Patent
Thomson

(10) Patent No.: US 10,329,674 B2
(45) Date of Patent: Jun. 25, 2019

(54) FLUORINATED ACID COMPOUNDS, COMPOSITIONS AND METHODS OF USE

(71) Applicants: Win Chemicals, Ltd., a Canadian corporation, Burlington (CA); Vitech International, Inc., a Delaware corporation, Burlington (CA)

(72) Inventor: Rodney Thomson, Burlington (CA)

(73) Assignees: Vitech International, Inc., Edgerton, WI (US); Win Chemicals, Ltd., Burlington, ON (CA)

( * ) Notice: Subject to any disclaimer, the term of this patent is extended or adjusted under 35 U.S.C. 154(b) by 0 days.

(21) Appl. No.: 15/828,142

(22) Filed: Nov. 30, 2017

(65) Prior Publication Data

US 2018/0155841 A1 Jun. 7, 2018

Related U.S. Application Data

(60) Provisional application No. 62/428,931, filed on Dec. 1, 2016.

(51) Int. Cl.

| | |
|---|---|
| ***C11D 7/10*** | (2006.01) |
| ***C23G 1/02*** | (2006.01) |
| ***C11D 7/32*** | (2006.01) |
| ***C11D 7/08*** | (2006.01) |
| ***C11D 3/04*** | (2006.01) |
| ***C11D 11/00*** | (2006.01) |
| ***C23F 1/20*** | (2006.01) |

(Continued)

(52) U.S. Cl.

CPC ..... *C23G 1/02* (2013.01); *C11D 3/042* (2013.01); *C11D 7/08* (2013.01); *C11D 7/3272* (2013.01); *C11D 11/0029* (2013.01); *C23F 1/20* (2013.01); *C23F 3/03* (2013.01); *C23G 1/08* (2013.01)

(58) Field of Classification Search

CPC ..... C23C 22/34; C23C 22/83; C11D 3/042; C11D 3/046

USPC ..... 427/388.4; 510/247

See application file for complete search history.

(56) References Cited

U.S. PATENT DOCUMENTS 4,479,543 A 10/1984 Kalfayan
6,060,122 A * 5/2000 Rossmaier ..... C23C 22/34 106/14.05

(Continued)

FOREIGN PATENT DOCUMENTS

JP 2003027263 A 1/2003

OTHER PUBLICATIONS

Nicholas A. Milne, Tom O'Reilly, Peter Sanciolo, Eddy Ostarcevic, Mark Beighton, Kelvin Taylor, Mark Mullett, Anthony J. Tarquin, and Stephen R. Gray; "Chemistry of silica scale mitigation for RO desalination with particular reference to remote operations," Water Research 65 (2014) 107-133, Jul. 12, 2014, published online.

*Primary Examiner* — Gregory E Webb

(74) *Attorney, Agent, or Firm* — Robert W. Dickerson, Jr.; Matthew J. Spark; Zuber Lawler & Del Duca LLP

(57) ABSTRACT

Novel acid-based chemistries that can be used in various cleaning, de-scaling, rust-removal, brightening, etching and other similar applications, including, but not limited to, those based upon hexafluorozirconic acid and other additives, such as urea in some applications, which are effective for a wide range of applications, while avoiding the health, safety and environmental issues that are often associated with the use of hydrochloric acid and other toxic chemistries.

11 Claims, 7 Drawing Sheets

Sample 1B-3 Sample 1B-2 Sample 1B-1

(51) Int. Cl.
*C23F 3/03* (2006.01)
*C23G 1/08* (2006.01)

(56) References Cited

U.S. PATENT DOCUMENTS

| | | | | |
|---|---|---|---|---|
| 6,558,480 | B1 * | 5/2003 | Rochfort | C23C 22/34 106/14.13 |
| 2003/0098091 | A1 | 5/2003 | Opdycke et al. | |
| 2004/0168748 | A1 | 9/2004 | Hartwig et al. | |
| 2008/0305341 | A1 * | 12/2008 | Plieth | B82Y 30/00 428/419 |
| 2011/0079392 | A1 | 4/2011 | Reyes | |
| 2012/0145401 | A1 | 6/2012 | Reyes | |
| 2013/0269936 | A1 | 10/2013 | Reyes et al. | |
| 2016/0060576 | A1 | 3/2016 | Batton et al. | |
| 2016/0264852 | A1 | 9/2016 | Beuterbaugh et al. | |

* cited by examiner

Sample 1B-3 Sample 1B-2 Sample 1B-1

5% Hexafluorozirconic acid

5% Phosphoric acid

5% ALB™ uTFB chemistry

5% HF (48%)

Solution C Solution B Solution A

FLUORINATED ACID COMPOUNDS, COMPOSITIONS AND METHODS OF USE

RELATED APPLICATION

This application claims priority to and incorporates by reference herein in its entirety U.S. Provisional Patent Application Ser. No. 62/428,931, entitled "Fluorinated Acid Compounds, Compositions and Methods of Use," filed Dec. 1, 2016.

FIELD OF THE INVENTIONS

The inventions herein described and claimed relate generally to acid-based chemicals and compositions that find primary, but not exclusive, utility in de-scaling, cleaning and brightening applications, and which provide effective products and applications that enhance health and safety, and alleviate the environment issues presented by other chemistries used for similar purposes.

BACKGROUND OF THE INVENTIONS

Removing unwanted surface contaminants and staining, such as rust or scale, from metal objects is a ubiquitous and at times very vexing problem that plagues a huge array of domestic, commercial and industrial installations, products and systems.

Not surprisingly, acids are an essential component in the myriad of cleaning products that exist and can be used in the extensive number of cleaning applications that require their unique cleaning and solubilizing attributes. One of the most common applications of acid-based cleaning solutions is found in the areas of descaling and metal oxide (e.g. rust) removal. The use of the word scale herein will generally refer to insoluble salts such as but not limited to calcium carbonate, sulfates and aluminosilicates. Metal oxides would encompass water insoluble oxides of metals such as but not limited to transition element oxides.

The formation, accumulation or build-up of scale can be a significant problem in many residential, commercial and industrial applications as it can diminish or even completely stop fluid flow through pipes, reduce heat exchange efficiency in boilers and evaporators, and adversely affect both utility and aesthetics in commercial and domestic situations such as in bathroom showers and fixtures (among many other instances). Calcium carbonate is a very commonly encountered scale in domestic, institutional and industrial applications. While removing the offending rust or scale is the primary objective, an equally important goal in many applications is to remove the rust or scale without changing the color of, or damaging, the underlying metal.

Theoretically, any acid that produces a calcium salt that is soluble in water/acid may be used to eliminate calcium carbonate scales. Mineral acids such as hydrochloric acid and phosphoric acid have been most often used for this type of scale, but such acids also present significantly elevated health, safety and environmental issues. For example, concentrated hydrochloric acid, both in solution (and the acidic mist that often accompanies use of the solution) can have a corrosive effect on human tissue, and can also cause damage to the eyes and lungs (among other adverse effects). See, for example, http://www.mdguidelines.com/toxic-effects-hydrochloric-acid, and https://medlineplus.gov/ency/article/002498.htm for the descriptions and warning about the use of hydrochloric acid. The latter website states: "Hydrocholoric acid is a lear, poisonous liquid. It is highly corrosive, which means it immediately causes severe damage, such as burning, on contact." That website goes on to describe the many adverse reactions and symptoms that can resulting from touching, swallowing or even breathing the fumes of, hydrochloric acid, and how immediate treatment is required. Therefore, products containing hydrochloric acid must be used very carefully, and it is recommended that the person using such products first don personal protective equipment, such a gloves, goggles, chemical-resistant clothing and shoes. These health and safety concerns have caused the United States Environments Protection Agency to rate and regulate hydrochloric acid as a "toxic" or "hazardous" substance.

The adverse environmental effects of hydrochloric acid are also significant, and are becoming more of a concern as they are increasingly recognized. See, for example, the article entitled "Hydrochloric acid: an overlooked driver of environmental change" that was published on Mar. 1, 2011 by the US National Library of Medicine, National Institute of Health (https://www.ncbi.nlm.nih.gov/pubmed/21288016). and the article entitled "HCl's Overlooked Environmental Effects" that was published on Feb. 3, 2011 by Chemical and Engineering News. (http://pubs.acs.org/cen/news/89/106/8906scene.html?T+Online+News).

In addition to these safety concerns for the user and environment issues, the storage, shipping and importation of such substances is regulated and require special handling and equipment, which can add materially to production and delivery costs associated with this acids. Therefore, notwithstanding its efficacy, the use of hydrochloric acid is often not the preferred option, such that searching for and developing alternatives that are as or nearly as effective as this "toxic" chemicals without the concomitant health, safety, environmental and other risks, has been is an ongoing endeavor in the field.

In the search for alternatives, organic acids such as citric, lactic and glycolic acid have also been employed in cleaning solutions as they are the more environmentally friendly and safer options for calcium carbonate scale removal. However, these acids are not as effective as hydrochloric acid (for example, the rate of scale removal using these acids is approximately $1/20^{th}$ that of hydrochloric acid; and exhibit a lower solubility of the calcium salts). These other acids may also contribute significantly to undesired Biochemical Oxygen Demand (BOD) and Chemical Oxygen Demand (COD) in industrial effluents, and this can limit their useful in these markets as well.

Urea acid salts have also been shown to have excellent application in this regard as they have much better health and safety profiles as compared to mineral acids (non-corrosive to skin, non-fuming, and lower corrosivity to metals). Further, the inherent acid strength in urea acid salts is significantly higher than organic acids (0.2 pKa vs 4 pKa) and therefore the rate of reaction with calcium carbonate scale to produce carbon dioxide and the associated calcium salt is much more rapid. In addition, the contribution of urea acid salts to BOD and COD can be significantly lower than with the organic acids (approximately one-third to one-half as much). Therefore, urea acid salts have shown some utility in this area.

The most commonly used urea acid salts available commercially are urea hydrochloride and urea sulfate. The latter compound has limited use in calcium carbonate removal because of the low solubility of calcium sulfate that is formed during use. Nevertheless, these chemistries have been shown to have excellent utility in multiple applications and in a wide range of applications, from retail-based bathroom cleaners to large scale industrial descaling to oil-well stimulation.

Another prevalent type of scale that is often encountered and must be removed includes the silicates, as well as silica ($SiO_2$, which is the common ingredient in sand). Simple silicates such as calcium silicate exist where the silicate is anionic and the calcium is the counter cation. The structure of the molecule is fairly simple and as such, it is a usually a relatively simple task to solubilize it. Many of the mineral acids listed above can be effective in this regard.

Calcium silicate, however, is not a commonly encountered scale. None of the acids discussed above are as effective as desired in the removal of many common silicates where there may be combinations of Ca, Mg, Al, Fe (or other elements) as the cations, such that dissolution with most mineral acids is not possible. The structure of these silicate compounds can be quite complex. The mineral acids are also ineffective at solubilizing silica (silicon dioxide). Similarly, certain metal oxides such as but not limited to aluminum oxide, are extremely difficult to solubilize using the mineral acids described above. For example, it has been found that solubilizing aluminum oxide from aluminum rails on trucks is a very difficult task with limited practical options available.

It is generally understood that hydrofluoric acid (that is, hydrogen fluoride, chemical symbol and hereinafter referred to as "HF") has proven to be a very effective chemistry of those previously available to solve these type problems as to which the other acid-based cleaning solutions mentioned above have not been found to be adequately effective in most instances. For example, in the case of complex silicates, HF reacts with the silicon center of the molecule and produces hexafluorosilicic acid which is highly soluble and which also forms soluble salts with calcium ions, which otherwise would precipitate as calcium fluoride. Thus, the combination of free hydrogen fluoride and the hexafluorosilicic acid effectively solubilizes the entire scale formation quickly.

Additionally, aluminum oxide which forms naturally on aluminum surfaces that are simply exposed to air, is solubilized by HF almost immediately upon contact at quite low concentrations, such as 0.1% active solution. It is believed that the mechanism of this solubilization is the formation of the metal fluoride ($AlF_3$ or $ALF_4$(1-)) in this case. Unfortunately, once the oxide layer is solubilized, the HF immediately attacks the underlying bare elemental aluminum, and usually in conjunction with sulfuric acid, can form a bright white surface, with the term "aluminum brightening" being commonplace in describing this application. In some applications, brightening may be desired, but there are other applications where that is unwanted. Therefore, in addition to the inherent safety, health and environmental issues attendant with the use of HF, the aluminum brightening after-effect is also a drawback in many applications. There may also be unwanted physical etching of the surface metal. Therefore, even without the health, safety and environmental concerns, HF is not the preferred choice in many applications.

Heretofore, HF has been generally considered by many in the industry as the most efficient chemistry to deal with the removal of complex silicate scales and metal oxides such as aluminum oxide. However, there are many other considerations that render the use of HF implausible or certainly undesirable. First and foremost is the health and safety profile of HF. Specifically, HF is able to penetrate through human skin on contact. It is has been postulated that the relative weakness of the HF acid (pKa 3.2) plays a significant role in this phenomenon. If it were a stronger acid, then it would exist in a more dissociated and ionic state, which would most likely impede passage across the skin. Exposure to HF at lower concentrations of 1-5%, if untreated, will result in burns to human skin that are not immediately evident, so the person being harmed may not be immediately aware of the danger and injury being sustained, such that prolonged exposure, and hence greater injury, may result. Eventually, however, tremendous pain develops in the area around the contact point for the victim. Often, necrosis of the skin will become evident and blackening of the affected finger/toe nails will take place, even after subsequent medical attention is received, frequently involving calcium gluconate injections. Therefore, the use of HF is often not preferred, notwithstanding its efficacy in a given application.

While the health, safety and environmental concerns with some acids can be ameliorated to a degree by combination with urea, that is not the case with HF. The relatively weak strength of HF as an acid is a reason why it will not effectively form a salt when mixed with urea. It may be that HF is simply not strong enough to react with urea to form a salt. This precludes one potential mechanism for making a safer version of HF.

In the case of higher concentrations of HF (when handling the raw material at 48% and higher content), unless immediate treatment with calcium gluconate cream is given, far more serious health effects due to hypocalcaemia may result in significant tissue damage requiring amputation, and even death may occur. Thus, as is well known, HF is a very "toxic" substance, which must be handled with extreme caution. And, as mentioned above, the significant adverse environmental effects of HF have become much more of a concern.

A further complication with the use of HF is the non-discriminatory nature of the corrosivity of the product. As an example, a silicate or silica based scale may coat a pipe or metal alloy in a boiler or evaporator, severely restricting the flow of fluids or impacting heat exchange efficiencies. HF would be able to remove the scale, but would also likely also corrode the underlying metal. And because the accumulation of scale is rarely if ever uniform on the underlying metal substrate, the HF will often contact and corrode the metal substrate in some areas while still dissolving the scale in other areas. The resulting corrosion to the underlying metal may be so damaging as to preclude the use of HF altogether. Another problem encountered with HF is when it makes contact with glass surfaces, either intentionally or inadvertently (such as may occur in an overspray situation). Depending upon the amount and solution strength, opacification of the glass can be virtually immediate, causing the need to replace the glass.

A similar problem can occur in cleaning transportation vehicles where the rails on the trailers, fuel tanks and other aluminum parts on the truck become dull with exposure to oxygen (causing the formation of aluminum oxide which creates a cloudy or dull surface appearance). Treatment with HF, typically formulated with sulfuric acid for this application, will effectively remove the dull surface material, but then almost immediately results in an oxidative attack of the base aluminum. This is evidenced by the evolution of hydrogen gas which is seen as effervescence on the metal surface. The result is a bright white surface that is generally viewed as undesirable, but has come to be grudgingly accepted as preferable to the more unsightly dull appearance before treatment. Most users, however, would prefer the bright shine of aluminum with only oxide removed. Therefore, although HF has proven effective in the removal of aluminum oxide, it has serious drawbacks as well.

Ammonium bifluoride (ABF) is a chemistry which is frequently used in the industry as an alternative to HF, mainly in an attempt to overcome some of the health and safety issues associated with the use of HF. ABF is a solid and is safer to use than the 48% or 70% liquid HF because the solid ABF will not cross the skin barrier. However, if there is any moisture (sweat) the user's skin, which is the case in many application situations, the ABF will immediately react with the sweat to form HF (0.5 mole for every mole of ABF) which can cause the severe health effects mentioned above. Further, when ABF is in aqueous solution (which is also common in many application situations), HF is formed and will have all of the health, safety and corrosivity issues associated with that chemistry. Therefore, while ABF is a preferred chemistry for some applications, it still has drawbacks that do not allow it to perform as an effective replacement for HF in many applications.

Thus, there exists a need in the art for chemistries that are able to demonstrate some or all of the functionality and efficacy of HF without its inherent and negative acute and chronic health, safety, environmental, corrosivity and other problems and drawbacks.

One alternative that has proven effective and safe, and which provided a significant advance in this field, is a chemistry based upon urea tetrafluoroborate (hereinafter "uTFB"). See, for example, U.S. Pat. No. 8,796,195. As described in that patent, the addition of low concentrations of acid inhibitors produced a chemistry that was a non-irritant to skin upon contact with the "as supplied material" having the total acidity typically associated with 48% fluoboric acid. Further, the uTFB chemistry has shown to be non-corrosive to mild steel, thereby allowing for non-regulated ground transport of the material in the U.S., which results in reduced shipping costs. Additionally, the corrosivity of the uTFB product has proven to be very low on a variety of metals such that commercially acceptable descaling operations that were not otherwise possible by chemical means, particularly with HF, can be effectively undertaken with the uTFB chemistry. Therefore, this uTFB chemistry has proven to be effective in multiple applications involving the removal of certain complex silicates, silica and aluminum oxide removal.

For example, polished aluminum wheels are commonly used on long- and short-haul trucks and trailers, due to the strength and light weight of the aluminum used. These wheels are constantly exposed to sunlight, oxygen, road grime and other contaminants. Therefore, they require frequent cleaning. While HF would be a very effective solution and was often used, in practice today it is very rarely used on these wheels due to both the pitting/corrosion of the metal and the permanent whitening of the metal that the HF will cause. The uTFB chemistry was an effective substitute because it is not only effective at removing the aluminum oxide thus exposing the polished aluminum below, but also is very slow to attack the bare aluminum and burn or whiten the metal. Therefore, it provided a safe-to-use chemistry that effectively cleaned and removed aluminum oxide without damaging the base metal.

Notwithstanding these substantial benefits and improvements in many applications realized with the uTFB chemistry, it is not a superior solution in some applications.

One of the highest volume cleaning applications in which this is encountered is in regard to cleaning the aluminum rails found on most transportation vehicle trailers. On new rails that have not been previously cleaned with HF, the uTFB chemistry will be quite effective in cleaning and brightening this metal, usually requiring a solution of about 1% activity. Unfortunately, the majority of the rails currently in use were previously routinely treated with HF, which, as described above, the HF caused significant etching of the surface and permanent whitening. Such surfaces are not well suited for cleaning with the uTFB chemistry, unless significantly higher concentrations (5-10%) are employed. Although even at this higher concentration, the safety profile of the uTFB chemistry is much better than for HF, the price-per-application of the higher-concentration uTFB material can be cost-prohibitive for some end users. Therefore, the uTFB chemistry was primarily used in this application as the "safe version" aluminum brightener that typically represents around 2-5% of total aluminum brightener applications.

It has also been found that the uTFB chemistry is not satisfactorily effective for the removal of rust and iron oxides in some circumstances. In those instances, supplemental chemistry must typically be added in order to improve efficacy in this application to an acceptable level. However, this adds costs and other drawbacks. Therefore, a need in the art existed for a chemical technology that does not use HF or require supplemental chemistry to be added to uTFB in order to improve iron oxide removal, and for other applications.

Another area in which these type cleaning chemistries have found particular utility is with complex silicates, where the uTFB chemistry has proven to be effective in some circumstances and applications where standard mineral acids would be ineffective. However, the uTFB chemistry has also been found to be relatively ineffective with other complex silicate scales. Thus, the uTFB chemistry is not a universal solution for this cleaning application.

In examining why the uTFB chemistry is not universally effective in this regard, one interesting feature of the uTFB chemistry that has been observed is the formation of some hexafluorosilicic acid during the dissolution of aluminum silicate. This appears to at least partly explain the ability of the uTFB chemistry to solubilize these difficult silicates. However, this phenomenon is difficult to understand in some ways, since the kinetics are not favorable for transfer of fluorine from boron to silicon (the B—F bond being much stronger than the Si—F bond). This is perhaps explained by the fact that one way to synthesize fluoboric acid is to react boric acid with hexafluorosilicic acid. This results in the formation of tetrafluoroboric (fluoboric) acid and $SiO_2$, however, without the significant exothermic reaction that is seen with the reaction of HF and boric acid. Nonetheless, this is important empirical information that has aided in the development of additional chemical technologies to overcome some of the technical and commercial issues and drawbacks described above.

In addition to the cleaning applications discussed above, there are innumerable other applications in which an acid solution would be the preferred chemistry to solubilize the particular scale, metal oxide or other contaminant from a metal or other substrate, but an HF solution is not preferred apart from health, safety and environmental issues. This could be because the HF will damage the metal or other substrate or the paint or other material on the substrate, or because of safety concerns. Very often, an acid cleaning solution is used by persons who have not been properly trained in the proper use and storage of toxic materials, and even if the proper instructions are included with the product, will either ignore them, or will not have the safety apparel readily available for safe use. A few such examples, without limitation, include cleaning road and atmospheric residue and grime from auto and truck bodies without damaging either the underlying metal or the paint applied on it; cleaning vehicle motors and motor parts, cleaning rusted tools, cleaning metal landscaping equipment, cleaning common household wares and appliances made of metal, and many more applications.

It is accurate to state that a long felt need in the art, the answer to which has proven quite elusive, is the development of a cleaning chemistry that can effectively remove scale and rust (and other residue and contaminants) from a wide variety of metal and other substrates, that can do so without damaging or undesirably "brightening" the substrate or damaging surface materials such as paint, or that will cause glass to become opaque, that can do so at sufficiently low acidic concentrations so the chemistry is not harmful to humans and the environment, and is not considered a "toxic" material that is subject to government regulations and concomitant higher costs in shipping, storage and use.

SUMMARY

The composition illustrated herein provides a cleaning chemistry that can effectively remove scale and rust (and other residue and contaminants) from a wide variety of metal and other substrates, that can do so without damaging or undesirably "brightening" the substrate or damaging surface materials such as paint, or that will cause glass to become opaque, that can do so at sufficiently low acidic concentrations so the chemistry is not harmful to humans and the environment, and is not considered a "toxic" material that is subject to government regulations and concomitant higher costs in shipping, storage and use.

In an illustrative embodiment, an acid-based cleaning composition for descaling and dissolution of complex silicates which does not release hydrofluoric acid comprises a combination of a fluorine containing acid selected from the group consisting of hexafluorophosphoric acid, hexafluorozirconic acid and hexafluorotitanic acid and an acid salt of the fluorine containing acid.

In a further illustrative embodiment, the acid salt comprises the reaction product of the fluorine containing acid and a weak base selected from the group consisting of urea, substituted ureas, short chained aliphatic amines, short chained olefinic amides, aromatic amides, pyrolles, pyrazoles and indoles.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The various present embodiments now will be discussed in detail with an emphasis on highlighting the advantageous features with reference to the drawings of various embodiments. The illustrated embodiments are intended to illustrate, but not to limit the invention. These drawings include the following figures, in which like numerals indicate like parts.

DETAILED DESCRIPTION

Figure 1:
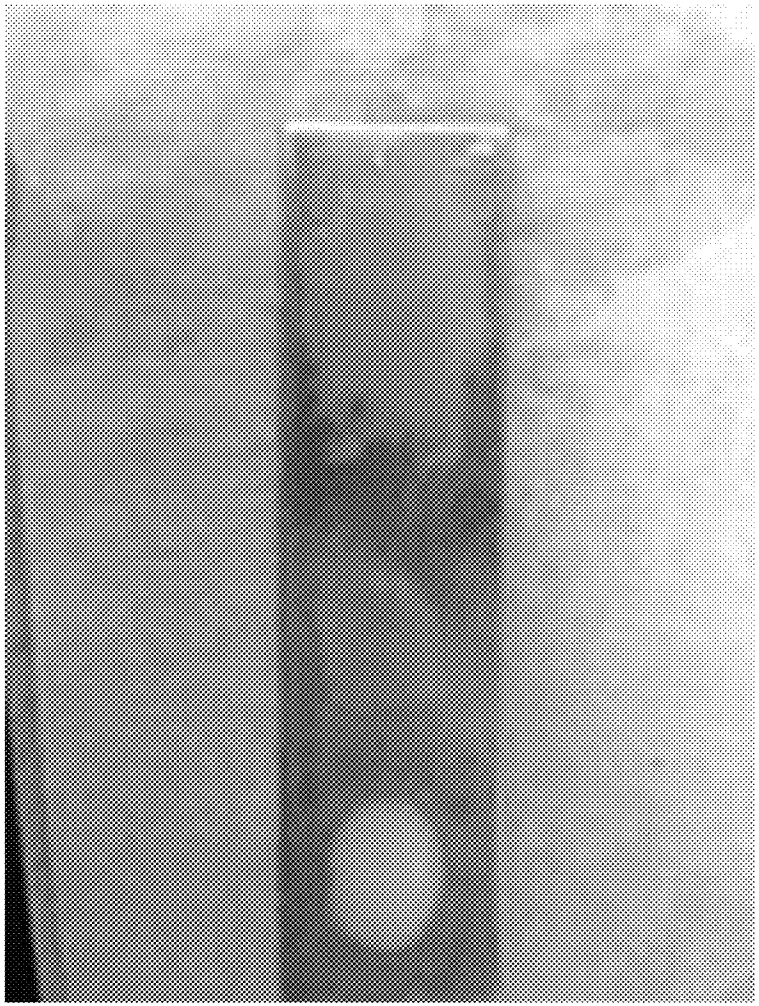
FIG. 1 is a photograph illustrating the results of testing of three (3) different formulations of solutions that were evaluated for the ability to etch/brighten aluminum.
Figure 2A:
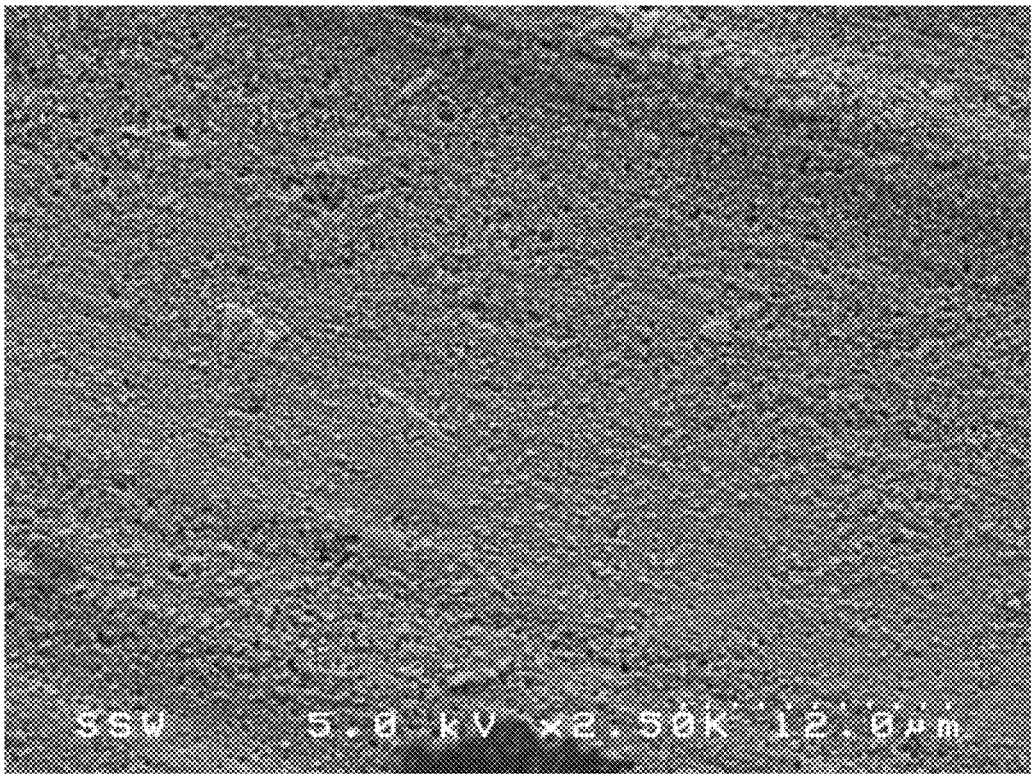
FIGS. 2A-D are, respectively, photographs of a 2500× magnification of 2024 aluminum alloy where a 5% Hexafluorozirconic acid, a 5% Phosphoric acid, a 5% ALB™ uTFB chemistry, and a 5% HF (48%) had been tested.
Figure 2B:
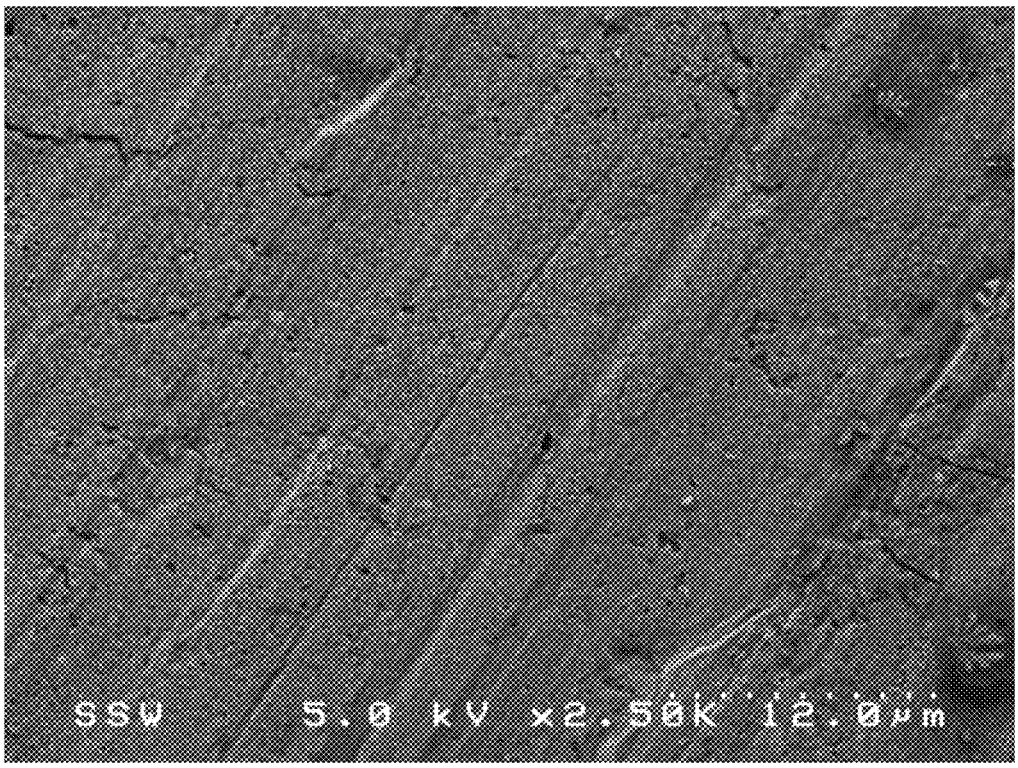
Figure 2C:
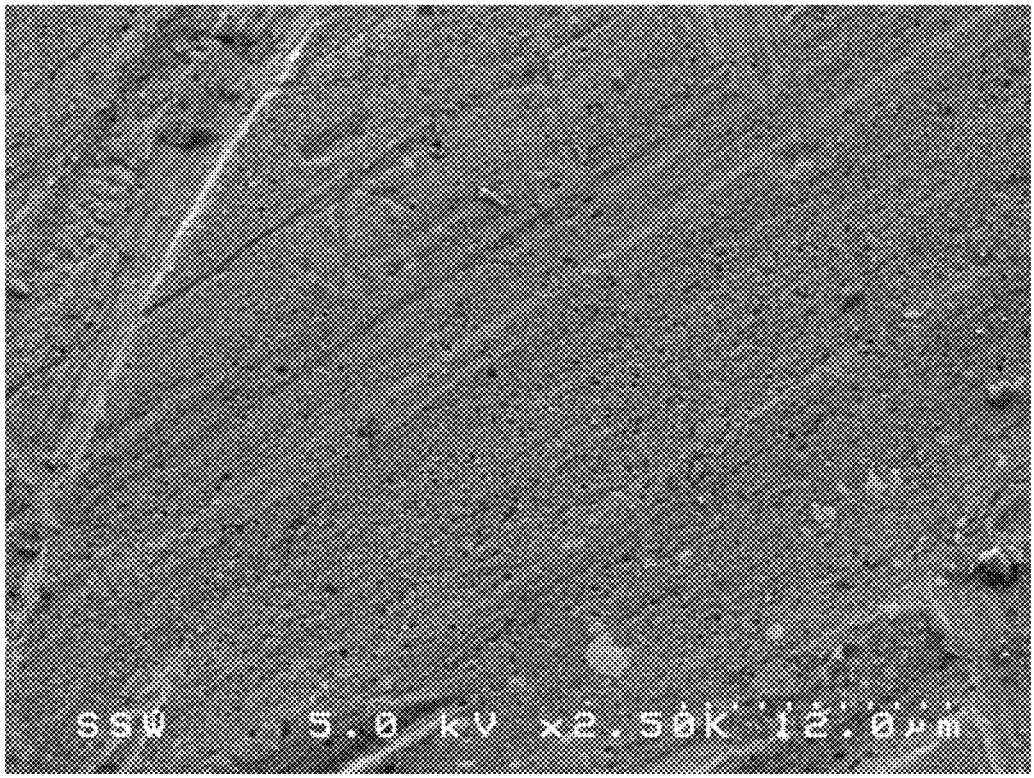
Figure 2D:
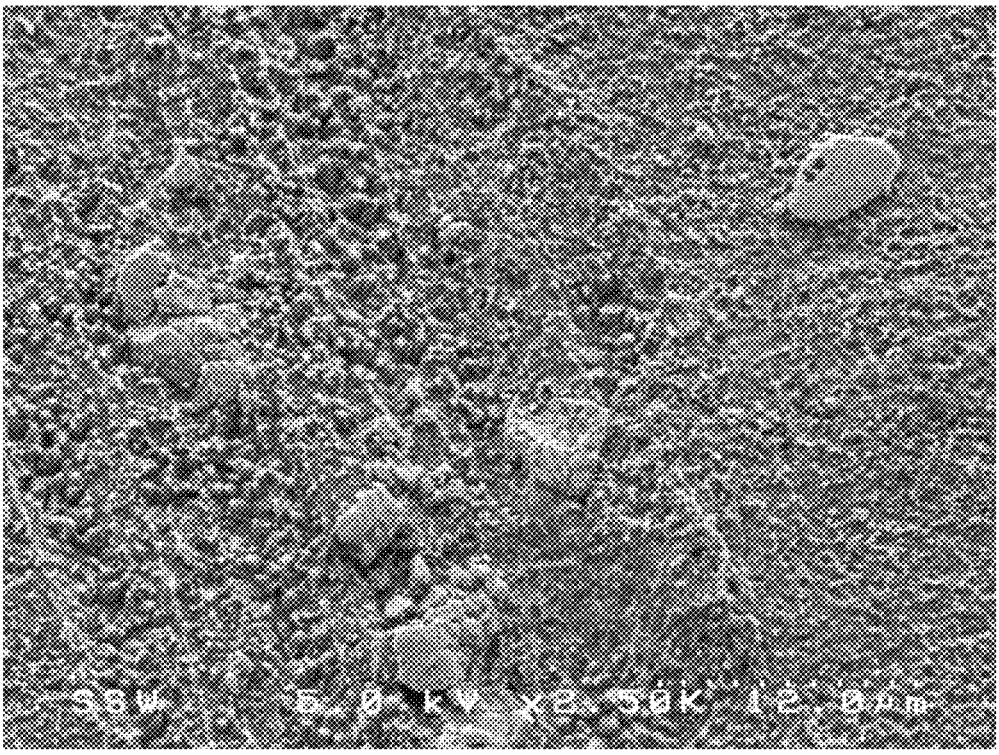

The inventions hereinafter described and claimed provide a chemistry that can more broadly, effectively and safely be used in place of HF in many cleaning, de-scaling, brightening and other applications. The compositions of the present inventions can be used as aqueous solutions or dispersions in a ready-to-use form. Alternatively, depending on the nature of use and application, the compositions can be in the form of a concentrate containing a high proportion of the described chemistry, with the concentrate being diluted with water before use. As demonstrated through use of certain embodiments, such concentrates can withstand storage for prolonged periods and after such storage be capable of dilution with water in order to form aqueous preparations which can remain homogeneous or otherwise dispersed for a sufficient time to enable them to be applied by conventional methods. After dilution to form aqueous preparations, such preparations may contain varying amounts of the active acid-based cleaning composition, depending upon the intended purpose or end-use application.

The compositions of the present inventions can be applied, formulated (typically including surfactants) or unformulated, directly to the surface to be treated, or they can be sprayed on, dusted on or applied as a solid, cream, paste or an emulsion, among other ways. Such embodiments as can be prepared using formulation techniques well-known to those skilled in the art. For instance, the compositions to be used as sprays may be in the form of aerosols wherein the formulation is held in a container under pressure of a propellant, e.g. fluorotrichloromethane or dichlorodifluoromethane.

As described above, HF is tremendously effective in many applications such as complex silicate and silica removal, aluminum brightening and ferric oxide (rust) removal. The common feature in each of these cleaning applications is the removal of oxides, including but not limited to silicon, aluminum and iron oxides. The mechanism by which HF solubilizes these oxides (which are generally insoluble or substantially in water) is understood to occur via a reaction to form the corresponding fluoride ($H_2SiF_6$, $AlF_3$, $FeF_3$). These compounds all exhibit water solubility, or certainly, solubility in aqueous HF.

As described above, the uTFB chemistry is very effective in solubilizing certain complex silicates, whereas it is somewhat ineffective as to other silicates. The cause of that phenomenon was not known, and research of the literature did not disclose a possible cause, or any cure. Research has shown that a possible explanation for this phenomenon stems from steric issues in the structure of the various silicate compounds, in conjunction with the relatively poor kinetics of fluorine transfer from boron to silicon (B—F being a stronger bond than Si—F).

This research also suggested that at least part of the mechanism for solubilization of these complex silicates is caused by the formation of the soluble hexafluorosilicic acid. The research also suggested that by using a different metal, metalloid or non-metal centered fluorine based acid, with more preferred kinetics for the fluorine-to-silicon transfer, a chemistry might be developed that would be effective across a broader spectrum of oxides and silicates, yet would still have the preferred health and safety profile of the uTFB chemistry.

In essence, once a possible cause for the phenomenon was found, then the research focused on searching for and developing a material that evidences reasonable binding of fluorine to the center, but then allows for a more facile transfer of the fluorine to silicon during descaling. This would mean that for any element used in the center of such an acid, the bond strength would be weaker than the Si—F or B—F bond.

Metalloid (e.g. boron) or metal (e.g. titanium) or even some non-metal (e.g. phosphorus) centered fluorine containing acids are very strong acids by their nature, due to the extreme electron withdrawing properties of fluorine. Therefore, these acids would have some inherent health and safety concerns typical of mineral acids such as sulfuric acid. However, it was postulated during research that if strong enough bonds are formed at this center, it might mean an absence of free HF which would mitigate the greatest dangers associated with HF which are the ability to pass through skin and the subsequent attack on calcium in the body.

Research discovered that there were a number of acids that might possibly prove effective, several of which are commercially available including but not limited to hexafluorophosphoric acid, hexafluorozirconic acid and hexafluorotitanic acid. The research discovered that many other related fluorine-containing acids might be used as well. This would include the transition metal elements including but not limited to iron, cobalt, nickel and zinc. It would also include Group III elements larger than boron; Group IV elements larger than silicon; and Group V elements larger than nitrogen.

Initial research sought to demonstrate improved descaling potential centered on the dissolution of a complex silicate taken from a geothermal scale (that is, scale that was formed in a geothermal environment, and which is among the more soluable-resistant scale material). Application of the uTFB chemistry did not result in any measurable weight loss of this material, even when heat was applied at 70° C. for several hours. However, when a solution of hexafluorozirconic (hereinafter "HFZ") acid was applied to the scale material, a surprisingly large amount of weight loss (approximately 85%) was measured, even at room temperature and without prolonged exposure. This amount of dissolution at room temperature and within a reasonable length of time meant that this would provide for effective descaling in the field, which is the "gold standard" for descaling products.

The mechanism of fluorine transfer to silicon in silicates will also play heavily into utility for transportation cleaning, among others. This would include the area of acid pre-soaks for touchless vehicle washing. In this industry, many of the vehicles are quite large, therefore the metal surfaces to be cleaned can be quite large, and difficult to access by hand. Thus, "touchless" cleaning is preferred.

Silicates are common components in typical road film deposited on vehicles as they are exposed to the elements. This is one reason why so many transportation cleaners use an acid pre-soak prior to an alkaline second step pre-soak (again, HF demonstrates very high performance in this application, but is not preferred by many users because of its health and safety profile and propensity to opacify glass). Effective dissolution of these silicates will result in much improved cleaning efficacy when the second step alkaline pre-soak is applied, resulting in removal of the film without the need for "touch."

Although good results in this application have been be obtained with the uTFB chemistry, using the novel and newly-discovered HFZ chemistry produced excellent results that exceeded expectations, while at the same time avoiding the significant and potentially severe adverse effects on health, safety and the environment associated with the use of HF (and other similarly toxic acids). One observation that has been made with the use of the new HFZ chemistry is that many preferred embodiments result in no opacification of glass upon contact, the opposite of the result obtained with HF-based cleaning. In most applications involving glass, opacification is undesired and thus is another reason why HF is not an acceptable solution. Significantly, when opacification does not occur, this is also a qualitative demonstration of the absence of free HF, as opacification of glass has been observed in reaction to a solution having as little as 0.1% active HF in concentration. The lack of free HF when using the novel HFZ chemistry is an unexpected but highly beneficial result.

The relatively slow rate of aluminum oxide dissolution/removal by the uTFB chemistry relative to HF has been discussed. The latter acid exhibits a "pop" when applied to aluminum which is considered to be the rapid reaction with aluminum oxide to form aluminum trifluoride which does exhibit water solubility. Secondly, the HF attacks the underlying aluminum metal and oxidizes it, producing hydrogen gas (an effervescence) in this redox reaction. The kinetics for fluorine transfer from boron to aluminum are significantly worse than boron to silicon. By using a different element centered fluorinated acid such as HFZ acid, the kinetics for fluorine transfer will certainly improve significantly, since the bond strength of Zr—F is much lower than B—F. In practice, we have seen even acids such as hexafluorosilicic acid outperform uTFB chemistry in this application, which further supports the premise as to why the HFZ chemistry provided improved results in some applications. Tests with the zirconium-centered fluorinated acid have also shown massive improvements in aluminum brightening.

Furthermore, since the fluorinated acids described and claimed herein will all be very strong, with pKa values well below 0, they will each be excellent candidates from which to make acid salts using compounds like urea (in essence, very weak bases) and substituted ureas. Other compounds that could potentially be used include short chained, aliphatic, olefinic and aromatic amides. Furthermore, the family of "ole" chemistry can be quite useful in this regard, including through the use of compounds such as but not limited to pyrrole, pyrazole and indole. Herein, the term "acid salt" refers generally to these such compounds. This will in turn allow for the manufacture of an acidic product that is not only safe from the perspective of being non-injurious when contacting skin, but also will significantly reduce the general corrosivity associated with strong acids that can result in thermal burns when in contact with tissue (notably skin). The mechanism of utility in the various applications available will be the same whether the product exists "as is" or as the acid salt (fluorine transfer from the fluorinated acid to an oxide such as silicone or aluminum). The acid salt will simply make the product safer from a typical acid burn perspective.

In light of the foregoing, it can be an object of the present inventions to provide various metal, metalloid or non-metal fluorine containing acids or the acid salts of these base acids which will allow for the dissolution of highly complex silicates and silica which otherwise could not be solubilized with uTFB acid based chemistry. These acids may be HF free or may contain lower concentrations of HF, improving the health and safety profile by either eliminating or reducing the possibility of fluorosis/hypocalcaemia upon contact with skin, and other adverse health and safety concerns associated with HF. Furthermore, the dissolution of these scales may be performed in both above ground (such as evaporator or scrubber descaling, or mining applications) and below ground applications (such as geothermal scales or in oil field fracturing/well stimulation). Additionally, these technologies will also have great utility in situations where biofilms have covered or are integrated into various scales. The technology will be efficacious for removal of both the biofilm and the scale. Equally importantly, this technology will avoid the adverse impact on the environment that can be caused by HF.

It can be another object of the present inventions to provide acid salts of various metal, metalloid or non-metal fluorine containing acids which demonstrate substantially improved removal of rust and iron oxides from hard surfaces as compared to tetrafluoroboric acid based chemistry or other non-fluorine containing mineral or organic acids. Additionally, it is an object of this present invention to improve the health, safety and environmental aspects of cleaning in this application as compared to HF and ABF.

It can be another object of the present inventions to provide various metal, metalloid or non-metal fluorine containing acids or the acid salts of these base acids which demonstrate substantially improved removal of aluminum oxide and aluminum brightening as compared to tetrafluoroboric acid or hexafluorosilicic acid based chemistries. Additionally, it is an object of this present invention to improve the health, safety and environmental aspects of cleaning in this application as compared to HF and ABF.

It can be another object of the present inventions to provide various metal, metalloid or non-metal fluorine containing acids or the urea acid salts of these base acids which demonstrate substantially improved removal of brake dust on wheels as compared to tetrafluoroboric acid based chemistry or other non-fluorine containing mineral or organic acids. Additionally, it is an object of this present invention to improve the health, safety and environmental aspects of cleaning in this application as compared to HF and ABF.

It can be another object of the present inventions to provide various metal, metalloid or non-metal fluorine containing acids or the acid salts of these base acids which demonstrate substantially improved performance as an acid pre-soak in touchless vehicle washing as compared to tetrafluoroboric acid based chemistry or other non-fluorine containing mineral or organic acids. Additionally, it is an object of this present invention to improve the health, safety and environmental aspects of cleaning in this application as compared to HF and ABF.

It can be another object of the present inventions to provide various metal, metalloid or non-metal fluorine containing acids or the acid salts of these base acids which demonstrate substantially improved performance as a weld or laser stain remover when compared to tetrafluoroboric acid based chemistry or other non-fluorine containing mineral or organic acids. Additionally, it is an object of this present invention to improve the health, safety and environmental aspects of cleaning in this application as compared to HF and ABF.

It can be another object of the present inventions to provide various metal, metalloid or non-metal fluorine containing acids or the urea acid salts of these base acids which demonstrate substantially improved performance as a metal etchant in the preparation of a rugous surface of a metal such as but not limited to aluminum or steel when compared to uTFB acid based chemistry or other non-fluorine containing mineral or organic acids. Additionally, it is an object of this present invention to improve the health, safety and environmental aspects of etching in this application as compared to HF and ABF.

It can be another object of the present inventions to provide various metal, metalloid or non-metal fluorine containing acids or the acid salts of these base acids which demonstrate substantially improved performance as an etchant in the preparation of a rugous surface of glazed ceramic material such as is present in bath tubs in order to reduce slip when compared to uTFB acid based chemistry or other non-fluorine containing mineral or organic acids. Additionally, it is an object of this present invention to improve the health, safety and environmental aspects of etching in this application as compared to HF and ABF.

It can be another object of the present inventions to provide various metal, metalloid or non-metal fluorine containing acid salts of these base acids which demonstrate efficacy in the electrodeposition of certain elements onto metal parts. Specifically, the use of the urea salts of these acids will allow for an improved health, safety and environmental profile when compared to acids such as methanesulfonic or sulfuric acid.

In certain other embodiments, the cleaning compositions of the present inventions can include one or more acid and/or corrosion inhibitor components. A corrosion inhibitor employed in the present invention can be any one or more corrosion inhibitors known to those skilled in the art and/or can be chosen on the basis of several factors including, but not limited to, the type of surface to be treated (metals, such as, aluminum, steel, iron, brass, copper, ceramics, plastics, glass etc.), the particular acid(s)/base components and concentrations thereof included in the system, system pH, the inhibitor efficiency, inhibitor solubility characteristics. desired length of exposure of the system to the surface, environmental factors, etc. Accordingly, the corrosion inhibitor can be any acid inhibitor known to one skilled in the art, including but not limited to, sulfonate, carboxylate, amine, amide and borated-based inhibitor compounds. In certain embodiments of the present inventions, the acid inhibitor can be an amine based inhibitor, optionally in concentrations from about 0.05 to about 0.3% weight percent. (Such amine based inhibitor compositions can be of the type sold under the registered trademark Armohib® by Akzo Nobel or its licensees).

Likewise, such compositions can optionally comprise one or more nonionic, anionic, cationic or amphoteric surfactants or a mixture thereof to improve both performance and economy. The type of surfactant selected can vary, for example, depending on the nature of the particular conditions of use (i.e. type of residue to be removed or type of surface), the particular system components (specifically, the use of a HZF component) and/or the nature of the solvent (aqueous versus a less polar solvent such as an alcohol or other organic solvent). In certain embodiments of the present invention, a composition can include a nonionic surfactant, such as that available under the trademarks WinSurf/Videt Q3, which demonstrates rapid wetting due to the excellent, associated dynamic surface tension profile (available from Win Chemicals Ltd. and Vitech International, Inc.).

Accordingly, in part, the present inventions can comprise a multipurpose, noncorrosive cleaning system comprising a combination of various metal, metalloid or non-metal fluorine containing acid salts and a corrosion inhibitor component applied to a surface. Such embodiments can provide a high activity product that can uniquely and surprisingly possess one or more of the following combined features: (1) no skin sensitivity/corrosivity after four hour exposure, non-irritant; (2) non-corrosive to aluminum as per standard Department of Transportation (DOT) test methods; (3) non-corrosive to mild steel as per standard Department of Transportation (DOT) test methods; (4) ready biodegradability; (5) extremely low odor profile; (6) non-fuming.

These inventions can also be directed to a method of treating or cleaning a surface (e.g., without limitation, a hard commercial or household surface) with various metal, metalloid or non-metal fluorine containing acid salts acid-based compositions, to remove surface contaminants. Such a method can comprise providing one or more of the compositions of this invention, including but not limited to those specifically described herein; and contacting a surface or a substrate with such a composition. The compositions of this invention and as can be used in such a method can comprise any one or more of the acid components discussed herein in combination with an organic nitrogenous base component, as can be considered in the context of the corresponding acid/base salt. Alternatively, such a composition can be prepared at or about the time of surface treatment, by mixing such metal, metalloid or non-metal fluorine containing acid component(s) and a nitrogenous base component. The surface may be contacted with the composition for a given period of time and/or to effect a specific level of cleaning, descaling and/or brightening activity on the surface. Accordingly, the invention includes, in part, a composite cleaning system comprising a substrate having at least a portion containing various metal, metalloid or non-metal fluorine containing acid salts disposed thereon, wherein cleaning activity is effected on the portion of the substrate coated with the composition. The types of substrates encompassed within the composite cleaning system of the present inventions can include, but are not limited to, metals, such as aluminum, steel or brass, ceramics, tile, stone, brick, glass, fiberglass, wood and/or composites thereof.

Alternatively, such a composition can be prepared at or about the time of surface treatment, by mixing such metal, metalloid or non-metal fluorine containing acid salts and a nitrogenous base component. The surface may be contacted with the composition for a given period of time and/or to effect a specific level of cleaning, descaling and/or brightening activity on the surface. Accordingly, the inventions and the preferred embodiments include, in part, a composite cleaning system comprising a substrate having at least a portion containing a metal, metalloid or non-metal fluorine containing acid salt composition disposed thereon, wherein cleaning activity is effected on the portion of the substrate coated with the composition. The types of substrates encompassed within the composite cleaning system of the present invention can include, but are not limited to, metals, such as aluminum, steel or brass, ceramics, tile, stone, brick, glass, fiberglass, wood and/or composites thereof.

Depending on the type of end-use application, compositions of the present inventions may also comprise any other required components including, but not limited to, solid or liquid carriers or propellants to facilitate application, surfactants, thickeners, thixotropic agents, penetrating agents, stabilizers, brighteners, as will be well known to those skilled in the art.

Other objects, features, benefits and advantages of the present inventions will be apparent in the summary above and in the descriptions of preferred embodiments, and will be readily apparent to those skilled in the art having the knowledge and experience in the area of cleaning compositions for a particular end-use cleaning application (e.g. industrial versus household cleaning applications and/or type of surface to be cleaned, metal, ceramic, fiberglass, plastic, glass, etc.). Such objects, features, benefits and advantages will be apparent from the above as taken in conjunction with the accompanying examples, data and all reasonable inferences to be drawn therefrom.

Examples of Some Embodiments of the Inventions

The following, non-limiting examples and data illustrate various aspects and features relating to the compounds, compositions and/or methods of the present inventions. The results of the associated testing show significant advancement in cleaning and descaling efficacies compared to those that have been described above that have similar health and safety profiles. It will be understood by those skilled in the art that similar results may be obtained by incorporating other acids into the formulae provided that the critical metal, metalloid or non-metal fluorine containing acids are included.

Example 1 A—Complex Silicate Scale Dissolution

The following formulations were used to test dissolution rates and efficacy of complex silicate scale taken from a geothermal application, using different exposure times and temperatures. The "% Dissolved" amount is based upon a relative weight calculation before and after treatment (for example, if the amount of scale on the treated substrate weighed too grams before treatment, and 15 grams after treatment, then the % Dissolved=85%).

25% Hexafluorozirconic acid (50%)
75% Water
25% Hexafluorotitanic acid (50%)
75% Water
50% Videt et ALB™*
50% Water Videt ALB™ is a urea tetrafluoroborate (uTFB) based chemistry that is approximately 60% active ingredient.

In each case, a measured sample of crushed scale was mixed in a plastic beaker for a period of time. Afterwards, the sample was filtered through a pre-weighed Whatman filter paper and the residue was weighed after drying. The % dissolution was calculated from the remaining residue.

| Test | Exposure Time | Temperature | % Dissolved |
|---|---|---|---|
| 50% ALB ™ | 4 hours | 60 C. | 0% |
| 25% H2ZrF6 | 1 hour | 62 C. | 85.0% |
| 25% H2TiF6 | 1 hour | 56 C. | 85.9% |

As this shows, the solution and treatment in accord with the inventions herein described show impressive efficacy compared to the uTFB chemistry, and approaches that which could be achieved with HF, without all of the health and safety concerns associated with later. In addition, the effect on the underling metal substrate will be much less than with HF. The losses are quite significant with the zirconium and titanium based chemistries and would be expected to effectively remove similar scale in real world scenarios.

Example 1 B—Aluminum Brightening

Three different formulations of solutions including the present inventions were evaluated for the ability to etch/brighten aluminum. In each case, the solution with the formulae shown below was applied as is to a coupon of aluminum (alloy T2024) and then rinsed and dried after an appropriate period of dwell time (60 seconds). In this testing, sulfuric acid was added to the ALB™ material (uTFB chemistry) to aid in the etching/brightening. Sulfuric acid was not used in the formulation below (%'s shown are by volume) containing hexafluorozirconic (HFZ) acid:

Formula 1B—1
8% Hexafluorozirconic acid
90.75% Water
1% Glucopon 215
0.25% Hydrophilic polymer
Formula 1B—2
16% Videt ALB™
10% Sulfuric acid
1% Glucopon 215
1% Videt eQi
72% Water
Formula 1 B—3
16% Videt ALB
10% Sulfuric acid
1% Glucopon 215
0.5% Hydrophilic polymer
72.5% Water The results of testing are shown in a photograph seen in FIG. 1. The area treated Sample 1 B—1 is on the right; the areas treated 1 B—2 is in the middle; and the area treated with 1 B—3 is on the left. As this clearly shows, the solutions using the novel chemistry described herein is superior with regard to aluminum brightening.

Example 1C—Aluminum Etchant

This testing involved the etching of aluminum alloys (7075 and 2024). In each case, 5% of the acid as received from the supplier was added to water. The acids tested included HF (48%), Vitech™ ALB™ (uTFB-based chemistry), phosphoric acid (75%) and HFZ acid (50%). The metal coupon was dipped into each solution separately at room temperature and allowed to dwell within the solution for 30 seconds. It was then rinsed with water and dried. SEM micrographs were then taken. Photographs are shown in FIGS. 2A-2D which represent a 2500× magnification on a 2024 aluminum alloy, each photograph showing alloy etched with a particular solution. The HF showed the most etch and the HFZ acid also showed appreciable etch. Neither the ALB™ solution nor the phosphoric acid showed any evidence of etch. It is evident that either some heat or longer dwell could result in a deeper etch using HFZ acid.

Example 1D—Automotive Pre-Soak

Testing was conducted on a 2016 Subaru Acura TLX (charcoal grey) soiled primarily with atmospheric fallout. Since the car was silver, it is difficult to visually determine cleaning, so, damp Kim wipes were used to remove remaining soils. The darker/more prevalent soil indicates lower cleaning efficiency. The following acid formulations were made up (% shown are by volume):

| Control | Solution |
|---|---|
| 12% Videt ™ APW ™ | 8% Urea with HFZ* |
| 3% Videt ™ eQi ™ | 3.0% Videt eQi |

-continued

| Control | Solution |
|---|---|
| 1.2% Milcoside 101 | 1.4% Micoside 101 |
| Balance water | Balance water |

*This solution comprised of 2.4% urea, and 6.6% HFZ acid (50% concentration).

In this test, 100 ml of an 80:1 dilution of each of the above was applied to the vehicle and allowed to drip down and dwell for 25 seconds. Then an alkaline pre-soak (identical in each case) was applied over each patch and allowed to dwell for 30 seconds. Then it was rinsed with approximately 30 psi tap water. While still slightly wet, a segment of the patch (equal areas in both cases and from the same relative position on the vehicle) cleaned is carefully wiped with a Kim wipe and allowed to dry. Comparisons can then be made after the wipes have dried. The HFZ acid showed less residual film than the uTFB based chemistry. This technique is rudimentary but shows efficacy on a comparative basis.

Example 1E—Rust Removal

Prior research has shown that the uTFB chemistry in conjunction with other additives (phosphonic acids, for example) resulted in outstanding rust removal when compared to traditionally used acids such as phosphoric acid.

Testing of the novel chemistries described herein was performed on rust which had been deposited over time on fiberglass walls in a coin operated car wash during the normal course. The rust develops over time because soluble Fe+2 salts present in the rinse water come into contact with the board due to the mist created during the rinse cycle. The iron subsequently oxidizes to Fe+3 and produces the unsightly stains shown in the photograph seen in FIGS. 3A and 3B. This type rust stain can be among the more difficult to remove without damaging the underlying substrate.

Tests were performed using the following solutions (with the % shown being determined by volume):

| Raw Material | Solution A | Solution B | Solution C |
|---|---|---|---|
| Hexafluorozirconic acid | 20.76% | 20.76% | — |
| Urea | 7.5% | — | — |
| Vitech ™ APW ™ | — | — | 20.76% |
| Water | 71.24% | 78.74% | 78.74% |
| Vitech ™Q3 ™* | 0.5% | 0.5% | 0.5% |

Vitech™ Q3™ is a nonionic based surfactant containing ethoxylates.

The HFZ acid used is 50% active.

Figure 3A:
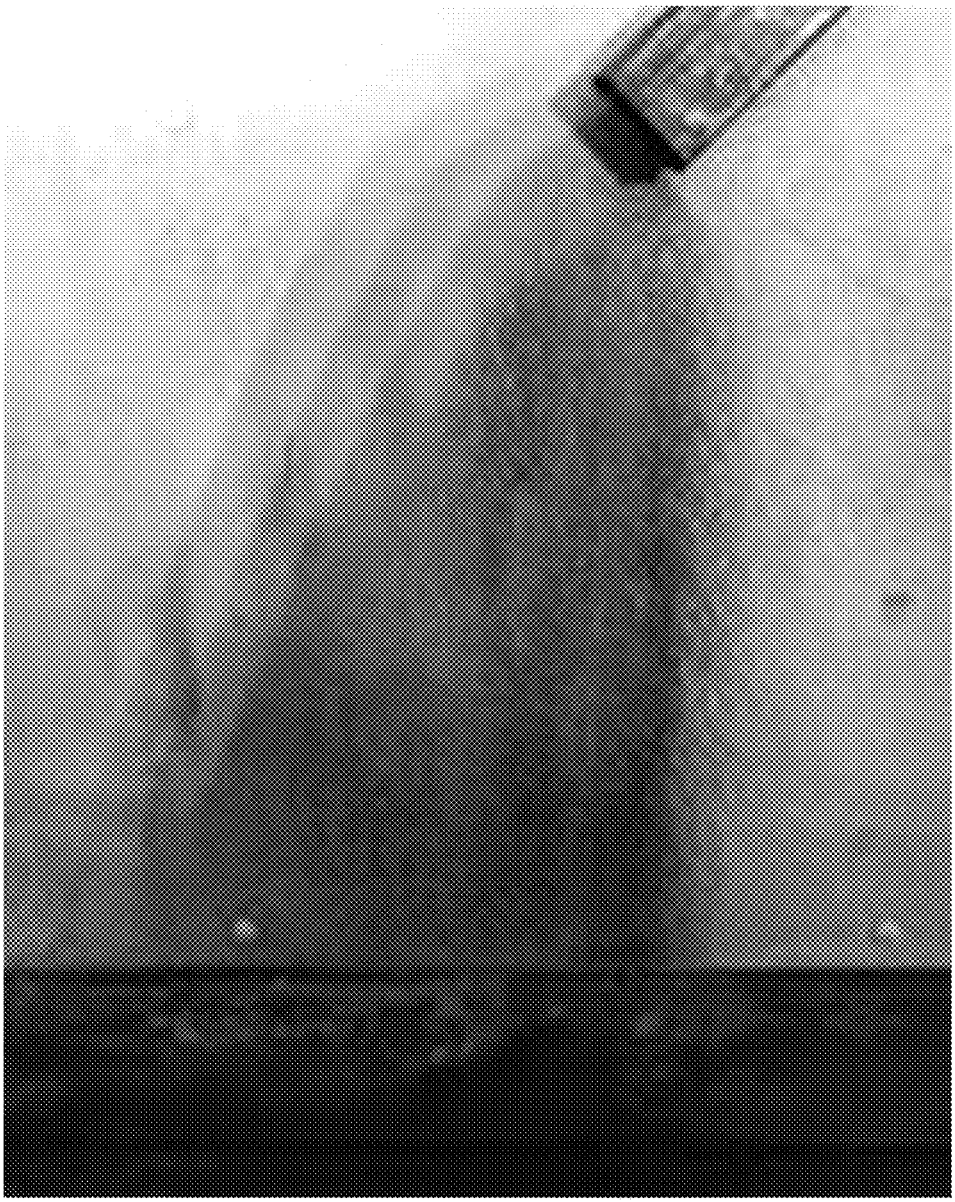
FIGS. 3A and 3B are, respectively, "before" and "after" photographs illustrating HFZ chemistry significantly outperforming uTFB based APW™ chemistry.
Figure 3B:
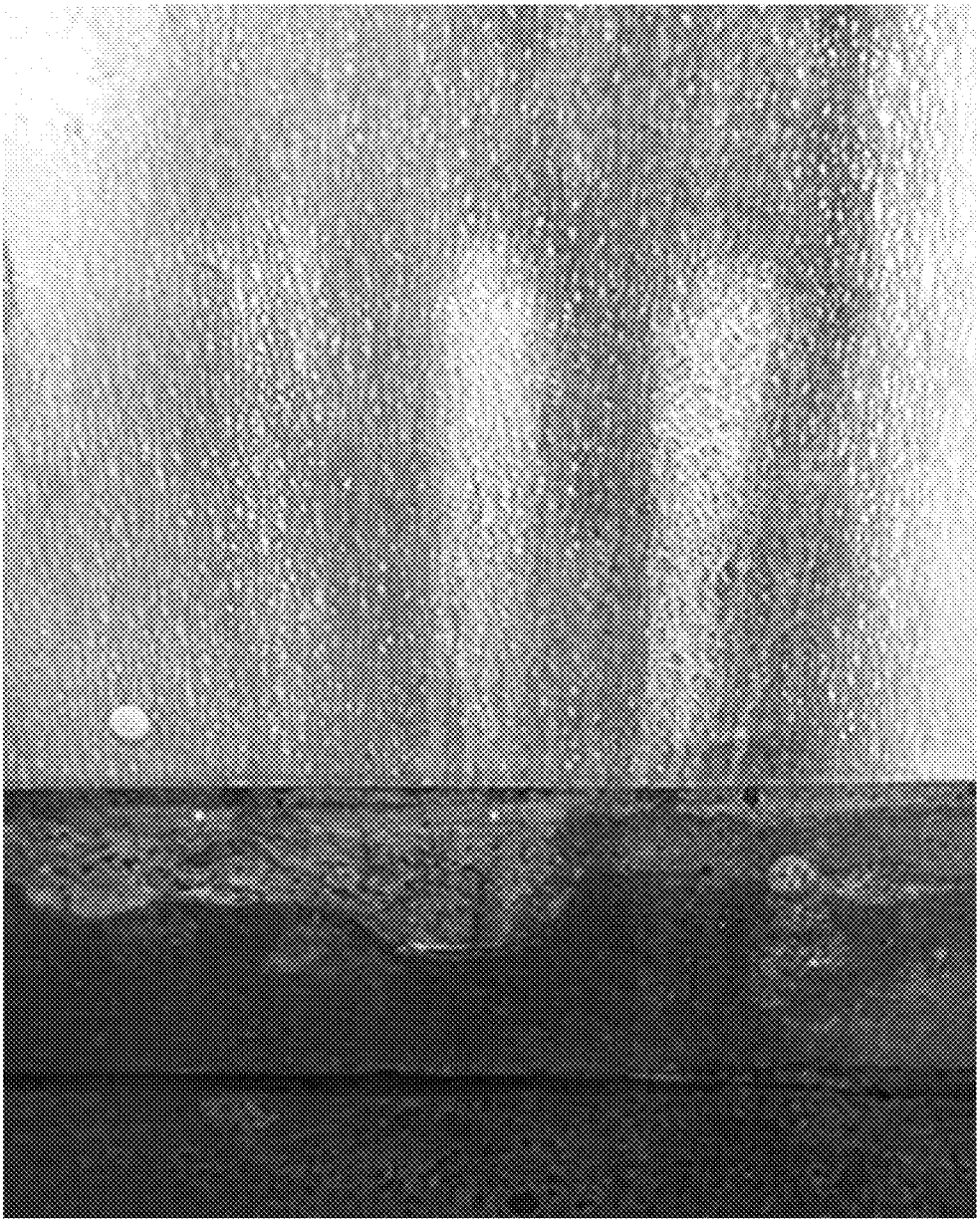

The results, depicted in the "before" and "after" photographs seen, respectively, in FIGS. 3A and 3B, showed the HFZ chemistry to significantly outperform the uTFB based APW™ chemistry. The photograph in FIG. 3A shows the stained wall prior to cleaning with any of the Solutions (i.e., Solutions A, B, and C) above.

The photograph seen in FIG. 3B shows the wall after one application with each of the Solutions (i.e., Solutions A, B, and C) described above, with the area being treated by Solution C on left, by Solution B in middle, and by Solution A on right.

Each Solution was simply sprayed on to test area from a container with a finger pump (10 equal pumps were applied onto each test area, and then allowed to stand without any brushing or any other abrasion applied). After 60 seconds, each area was wiped with a new and clean KimWipe, with equal had-pressure being applied as to each area (by the same person), with each area being wiped with an up-and-down motion for to cycles. The APW™ based solution (Solution C) was applied to the area of rust stained fiberglass board that had the lightest amount of the stain.

Example 1F—Laser Scale Remover

A piece of steel with laser scale on all edges was immersed in the solution below. It was allowed to remain in contact with the solution for a total of 1.5 minutes and then was rinsed with water. No scraping or other abrasive action was applied to the sample. Almost all of the scale was removed where there was contact. A simple wipe with a paper towel easily removed the rest. This was compared to the urea tetrafluoroborate chemistry (TFB at 25%) which showed virtually no removal at all after to minutes. The solution below thus represents a significant improvement in efficacy.

7.5% Urea
20.7% Hexafluorozirconic acid (50% active)
Balance water

The examples shown above are just a very few of the types of contaminants and scales, and the circumstances in which they arise, that can be removed with the novel chemistries described above. It will be understood by those in the art that the inventions and inventive concepts herein described are not limited to the specific examples and embodiments shown above, but are and include those within the full breadth and scope of the following claims, and equivalents thereof.

Example 1G—Preparation of Ureahexafluorozirconate

This reaction is quite facile and happens instantaneously. The hexaflurozirconate is poured into a plastic beaker or container and the urea is added into it. No exotherm is experienced so this is also a safe reaction to perform. Below is a preferred embodiment:

79.0 g of hexafluorozirconic acid
Add
28.6 g urea
Add
274 g DI water
Mix until no further solids are visible.
This represents a 25% solution of ureahexafluorozirconate.

This same technique would be used to make a hexafluorotitanium (or similar) urea based acid salt. Numbers are adjusted to ensure >1:1 mole ratio of urea to the acid in terms of normality.

While certain examples and embodiments of the compound, compositions and methods of use and other applications for the inventive concepts disclosed have been set forth above, the breadth and scope of the inventions herein disclosed are not limited thereby, and these inventive concepts will find utility in other embodiments, areas and applications as well. By way of other examples, and not in any way limiting, the inventive concepts herein disclosed will find utility in the following additional applications, among many others: transportation vehicles and parts (brightening and presoak), de-smutting in metalworking, marine cleaning (esp. pontoon boats), aluminum can manufacturing, HVAC systems and equipment, etching aluminum for metalworking pre-treatments, anodizing metals, steam flooding descaling, cooling tower cleaning and descaling, food processing descaling, micro etching tile for slip, silicate removal for fracking, etching chips (computer industry), automotive aftermarket parts making, rust removal (concrete and building), glass cleaner (water spot remover), etching for stained glass manufacture, building restoration, laundry stain remover, autodish descaler, industrial aluminum extrusion and rolling, phosphatizing add-in, and scrubber cleaning.

Therefore, the breadth of protection provided by this patent is not limited to those specific compounds, composition and methods of use set forth above, but is of the full scope as defined by the following claims, and equivalents thereof.

What is claimed:

1. An acid-based cleaning composition for descaling and dissolution of complex silicates which does not release hydrofluoric acid comprising a combination of a hexafluorozirconic acid, an acid salt of the hexafluorozirconic acid, and a corrosion inhibitor.

2. The acid-based cleaning composition of claim 1, wherein the acid salt comprises the reaction product of the hexafluorozirconic acid and a weak base selected from the group consisting of urea, substituted ureas, short chained aliphatic amines, short chained olefinic amides, aromatic amides, pyrroles, pyrazoles and indoles.

3. The acid-based cleaning composition of claim 1, wherein the corrosion inhibitor is selected from the group consisting of sulfonate-based, carboxylate-based, amine-based, amide-based, and borated-based corrosion inhibitors.

4. The acid-based cleaning composition of claim 1, wherein the corrosion inhibitor comprises an amine-based corrosion inhibitor.

5. The acid-based cleaning composition of claim 1, further comprising a surfactant.

6. An acid-based cleaning composition for descaling and dissolution of complex silicates which does not release hydrofluoric acid comprising a combination of a hexafluorozirconic acid and a corrosion inhibitor.

7. The acid-based cleaning composition of claim 6, wherein the corrosion inhibitor is selected from the group consisting of sulfonate-based, carboxylate-based, amine-based, amide-based, and borated-based corrosion inhibitors.

8. The acid-based cleaning composition of claim 6, wherein the corrosion inhibitor comprises an amine-based inhibitor.

9. The acid-based cleaning composition of claim 6, further comprising a surfactant.

10. An acid-based cleaning composition for descaling and dissolution of complex silicates which does not release hydrofluoric acid comprising a fluorine containing acid wherein fluorine is combined with a metal, non-metal or metalloid selected from the group consisting of transition metal elements, Group III elements having an atomic weight larger than the atomic weight of boron, Group IV elements having an atomic weight larger than the atomic weight of silicon and Group V elements having an atomic weight larger than the atomic weight of nitrogen.

11. The acid-based cleaning composition of claim 10, wherein the transition metal elements are selected from the group consisting of iron, cobalt, nickel and zinc.

* * * * *